US009917365B1

(12) United States Patent
Kauser et al.

(10) Patent No.: US 9,917,365 B1
(45) Date of Patent: Mar. 13, 2018

(54) RECONFIGURABLE ANTENNAS FOR MILLIMETER-WAVE SYSTEMS THAT SUPPORT MULTIPLE BEAMS

(71) Applicant: BOISE STATE UNIVERSITY, Boise, ID (US)

(72) Inventors: Ahmed Umar Kauser, Boise, ID (US); Hani Mehrpouyan, Boise, ID (US)

(73) Assignee: BOISE STATE UNIVERSITY, Boise, ID (US)

( * ) Notice: Subject to any disclaimer, the term of this patent is extended or adjusted under 35 U.S.C. 154(b) by 71 days.

(21) Appl. No.: 15/253,550

(22) Filed: Aug. 31, 2016

(51) Int. Cl.

| | |
|---|---|
| ***H01Q 3/26*** | (2006.01) |
| ***H01Q 1/24*** | (2006.01) |
| ***H01Q 21/00*** | (2006.01) |
| ***H01Q 3/24*** | (2006.01) |
| ***H01Q 1/36*** | (2006.01) |

(52) U.S. Cl.
CPC ..... *H01Q 3/26* (2013.01); *H01Q 1/243* (2013.01); *H01Q 1/36* (2013.01); *H01Q 3/24* (2013.01); *H01Q 21/00* (2013.01)

(58) Field of Classification Search
CPC ..... H01Q 3/26; H01Q 1/243; H01Q 1/36; H01Q 3/24; H01Q 21/00
See application file for complete search history.

(56) References Cited

U.S. PATENT DOCUMENTS

| | | | |
|---|---|---|---|
| 7,425,928 | B2 | 9/2008 | Chiang et al. |
| 7,696,943 | B2 | 4/2010 | Chiang |
| 8,912,957 | B2 | 12/2014 | Lin |
| 9,024,823 | B2 | 5/2015 | Bevelacqua |
| 9,035,838 | B2 | 5/2015 | Le Bars et al. |

*Primary Examiner* — Graham Smith
(74) *Attorney, Agent, or Firm* — Parsons Behle & Latimer

(57) ABSTRACT

An apparatus may include two or more active antenna elements with a corresponding antenna pattern. The apparatus may further include a single radio frequency signal chain communicatively coupled with the two or more active antenna elements. The apparatus may also include multiple passive antenna elements in proximity to the two or more active antenna elements. The multiple passive antenna elements may alter the antenna pattern to form multiple simultaneous beams associated with the two or more active antenna elements.

20 Claims, 10 Drawing Sheets

RECONFIGURABLE ANTENNAS FOR MILLIMETER-WAVE SYSTEMS THAT SUPPORT MULTIPLE BEAMS

FIELD OF THE DISCLOSURE

This disclosure relates generally to the field of reconfigurable antennas and more particularly to reconfigurable antennas for millimeter-wave systems that support multiple beams.

BACKGROUND

As data throughput demands for wireless communication grow, new techniques for antenna communications are needed. The explosive demand for wireless services and applications has led to extensive research towards 5G systems. In order to handle the high data rates associated with 5G systems, smart or reconfigurable antennas may be incorporated into wireless communication devices. These antennas provide more degrees of freedom and may support millimeter-wave communication, which operates at frequencies in the range from 30 GHz and 300 GHz, by using beam steering or beam forming to reduce signal loss. Multiple-input-multiple-output (MIMO) communication, which enables higher data throughput for 4G and 5G systems, may also be enabled. Smart antennas may decrease interference, increase data rates, reduce eavesdropping over wireless links, and reduce the effect of continuous stray radiation on human health.

In smart antennas, electronic beam steering is typically achieved through the use of phased array antennas. In phased array antennas, each antenna element has a phase shifter and a radio frequency (RF) signal chain. As such, phased array antennas have multiple RF signal chains to support each antenna element. Having multiple RF signal chains may increase the power consumption of a wireless communication system. Further, multiple RF signal chains may increase the costs of manufacturing the wireless communication system.

SUMMARY

Disclosed are systems and methods that overcome at least one of the limitations of typical wireless communication systems. In an embodiment, a set of passive antenna elements surround multiple active antenna elements. An electrical length of the passive elements may be controlled by opening, shorting, or changing the impedance (e.g., resistance, inductance, capacitance) of each passive element. By opening, shorting, or changing the impedance of the passive elements, an antenna pattern may be formed with multiple maxima beams directed toward the open passive elements. The multiple beams may be associated with a single radio frequency (RF) chain.

In an embodiment, an apparatus includes two or more active antenna elements with a corresponding antenna pattern. The apparatus further includes a single radio frequency signal chain communicatively coupled with the two or more active antenna elements. The apparatus also includes multiple passive antenna elements in proximity to the two or more active antenna elements. The multiple passive antenna elements alter the antenna pattern to form multiple simultaneous beams associated with the two or more active antenna elements.

In some embodiments, the apparatus includes a beam controller switch array that selectively applies impedances to the multiple passive elements to enable the multiple simultaneous beams to be steered. In some embodiments, each of the multiple simultaneous beams are independently steerable. In some embodiments, the multiple passive antenna elements are positioned substantially equidistant from the two or more active antenna elements and in a circular or elliptical pattern. In some embodiments, the apparatus includes two or more second active antenna elements communicatively coupled to the single radio frequency signal chain. In some embodiments, the multiple simultaneous beams enable millimeter wave wireless communication. In some embodiments, the multiple simultaneous beams enable 60 gigahertz communication. In some embodiments, the multiple simultaneous beams enable diversity and beam forming type multiple-input-multiple-output communication. In some embodiments, the multiple simultaneous beams enable special-diversity-type multiple-input-multiple-output communication. In some embodiments, the single radio frequency signal chain includes one or more signal amplifiers, one or more signal converters, one or more signal buffers, one or more digital-to-analog converters, one or more analog-to-digital converters, one or more signal modulators or demodulators, or combinations thereof, configured in series to form a signal chain. In some embodiments, the apparatus may be incorporated into a mobile computing device selected from the group consisting of cellular telephones, wearable computing devices, portable music players, tablet computers, and laptop computers.

In an embodiment, a method includes generating an antenna pattern at two or more active antenna elements. The method further includes transmitting or receiving a communication via the two or more active antenna elements using a single radio frequency signal chain. The method also includes altering the antenna pattern, using multiple passive antenna elements in proximity to the two or more active antenna elements, to form multiple simultaneous beams associated with the two or more active antenna elements.

In an embodiment, a method includes communicatively coupling two or more active antenna elements to a single radio frequency signal chain, the two or more active antenna element having a corresponding antenna pattern. The method further includes positioning multiple passive antenna elements in proximity to the two or more active antenna element. The multiple passive antenna elements alter the antenna pattern to form multiple simultaneous beams associated with the two or more active antenna elements.

Advantages of the disclosed system include achieving higher gain at millimeter (mm) wave frequencies to counter the path loss at those frequencies, more degrees of freedom supported by multiple beams that allow for beam forming and beam steering communication approaches, a reduction in transmission power waste due to directional transmissions, a reduction in exposure to stray radio RF radiation, a reduction of interference, an increase of security due to the directional nature of the transmission, and a reduction in the size and cost of manufacturing wireless communication systems.

Figure 1:
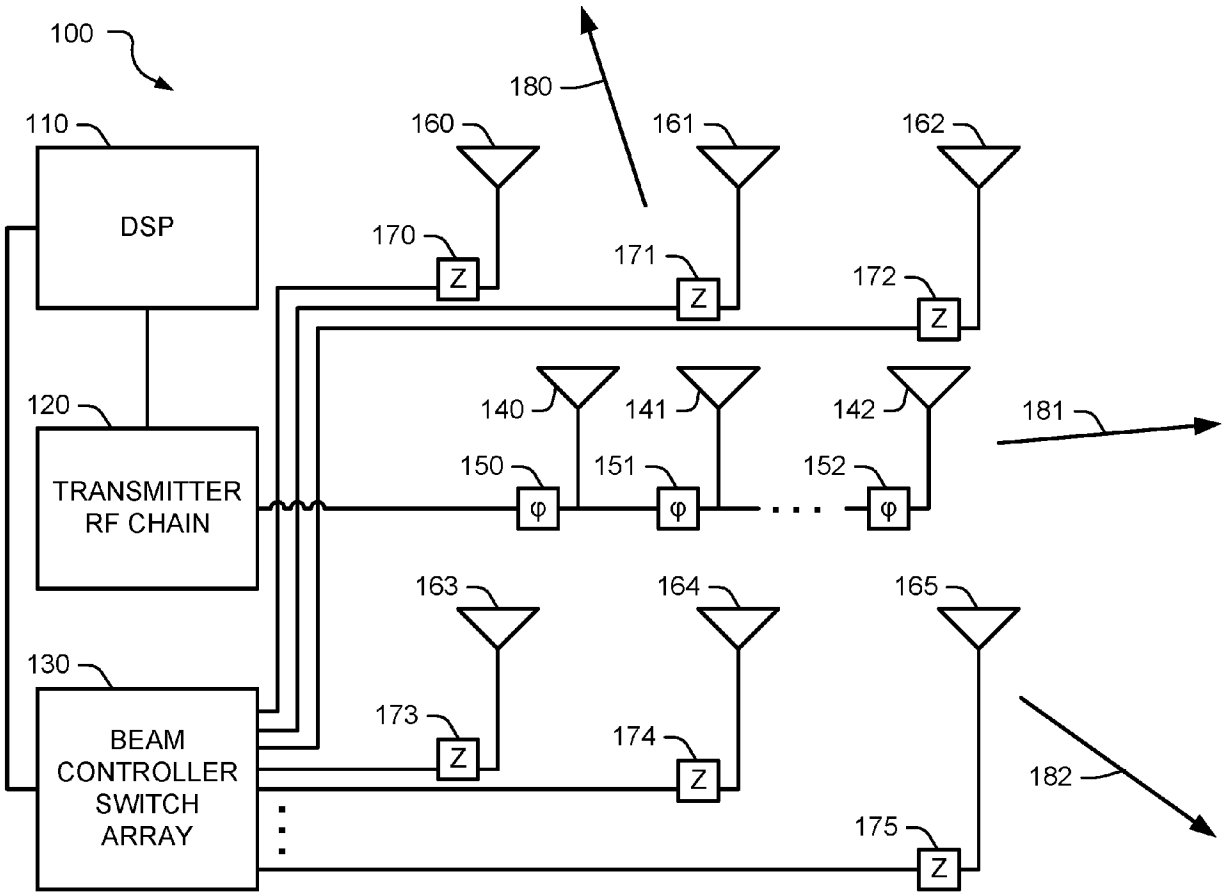
FIG. 1 is a schematic block diagram of an embodiment of a communication system configured for transmitting data via multiple beams using a single radio frequency signal chain.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

Referring to FIG. 1, an embodiment of a communication system is depicted and generally designated 100. In the embodiment depicted in FIG. 1, the system 100 is configured for transmitting data. The system 100 may include a digital signal processor (DSP) 110, a transmitter radio frequency (RF) signal chain 120, a beam controller switch array 130, two or more active antenna elements 140-142, and multiple passive antenna elements 160-165.

The DSP 130 may include any type of digital signal processing element capable of processing communication data. In the alternative, or additionally, other processors may be used for digital signal processing. For example, the system 100 may include a central processing unit (CPU), a graphical processing unit (GPU), a peripheral interface controller (PIC), another type of processing unit, or combinations thereof. The system 100 may further be implemented using programmable or fixed circuit logic such as a field programmable gate array (FPGA), an application specific integrated circuit (ASIC), an integrated circuit (IC) device, another type of circuit logic, or combinations thereof.

The transmitter RF signal chain 120 may include any number of devices and components that encode or decode a signal transmitted via airborne electromagnetic radiation. As used herein, a single transmission RF signal chain includes elements that convert a single electronic signal, or a single multiplexed electronic signal, to a carrier wave signal suitable for airborne transmission. A single transmission RF signal chain excludes additional elements that may convert additional electronic signals, or additional multiplexed signals, to other carrier wave signals. An embodiment of the transmission RF signal chain 120 is discussed further with reference to FIG. 3.

The transmitter RF signal chain 120 may be coupled between the DSP 110 and the two or more active antenna elements 160-165. Although FIG. 1 depicts the two or more active antenna elements 140-142, the transmitter RF signal chain 120, and the DSP 110 as coupled directly together, this is for explanatory purposes only. Other configurations are possible. For example, additional devices and components may be positioned between the two or more active antenna elements 140-142, the transmitter RF signal chain 120, and the DSP 110, as may be desirable for a particular application or purpose.

The beam controller switch array 130 may include switches, relays, decoders, other switching circuitry, other selection circuitry, or combinations thereof, in order to select and apply impedances to the multiple passive antenna elements 160-165. For example, each of the multiple passive antenna elements 160-165 may be associated with respective impedance sources 170-175. The beam controller switch array 130 may independently set an impedance at each of the impedance source 170-175. The beam controller switch array 130 may further independently and selectively couple and uncouple the impedance sources from the passive antenna elements 160-165. In some embodiments, the impedance sources 170-175 may provide a binary selection between shorting their respective passive antenna elements 160-165 with a ground or common circuit node and disconnecting their respective passive antenna elements 160-165 from the ground or common circuit node. In some embodiments, the impedance sources 170-175 may include simple impedance sources, such as resistors, potentiometers, or combinations thereof. In other embodiments, the impedance sources 170-175 may include complex impedance sources, such as capacitors, inductors, resonant stubs, varactors, or combinations thereof.

The two or more active antenna elements 140-142 may include any type of antenna element capable of transmitting or receiving an electromagnetic signal. For example, the two or more active antenna elements 140-142 may include di-pole antenna elements, mono-pole antenna elements, loop antenna elements, or other types of antenna element. The two or more active antenna elements 140-142 may be configured to transmit airborne electromagnetic signals from the system 100 to a remote wireless device. The term active means that the two or more active antenna elements 140-142 perform the actual transmission of the electromagnetic signals as opposed to the multiple passive antenna elements 160-165 that merely alter the antenna pattern of the two or more active antenna elements 140-142 rather than transmit airborne electromagnetic signals.

In some embodiments, one or more phase shifters 150-152 may be coupled between each of the active antenna elements 140-142 and the transmitter RF chain 120. The one or more phase shifters 150-152 may include passive electrical components, such as capacitors and inductors, to shift a phase of a signal to be transmitted. In some embodiments, the one or more phase shifters 150-152 may be omitted.

During operation of the system 100, the DSP 110 may send information to the transmitter RF chain 120 for transmission to a remote device (not shown). The transmitter RF chain 120 may convert and encode the information into a carrier signal before sending the carrier signal to the two or more active antenna elements 140-142.

While the carrier signal is being transmitted by the two or more active antenna elements 140-142, or shortly before the transmission, the DSP may instruct the beam controller switch array 130 to control the impedance sources 170-175. By switching connections between the impedance sources 170-175 and the multiple passive antenna elements 160-165, or by otherwise altering the impedances associated with the impedance sources 170-175 and applied to the multiple passive antenna elements 160-165, the antenna pattern exhibited by the two or more active antenna elements 140-142 may be altered to form multiple simultaneous beams 180-182 associated with the two or more active antenna elements 140-142. By selectively changing the impedances generated by the impedance sources 170-175, the multiple simultaneous beams 180-182 may be steered. In some embodiments, the multiple simultaneous beams 180-182 may be steered independent of each other.

Although, FIG. 1 depicts six passive antenna elements 160-165, the system 100 may include more or fewer than six passive antenna elements as shown by the vertical ellipses between the connections to the beam controller switch array 130. Further, although FIG. 1 depicts three simultaneous beams 180-182, in some embodiments, the system 100 may emit more or fewer than three simultaneous beams. Also, although FIG. 1 depicts three active antenna elements 140-142, in some embodiments, the system 100 may include more or fewer than three active antenna elements as indicated by the horizontal ellipses.

By emitting multiple simultaneous beams 180-182 corresponding to the single transmitter RF chain 120, the system 100 may enable diversity and beam-forming type MIMO communication via the single RF chain. The system 100 may also be smaller and may consume less power than systems that include multiple RF chains to enable MIMO communication, such as traditional ESPAR systems. Further, the system 100 may be configured to provide millimeter (mm) wave communication. For example, as part of mm wave communication, the beams 180-182 may enable 60 gigahertz communication. As used herein, 60 gigahertz communication is defined as a type of communication that makes use of signals within a range of the electromagnetic spectrum approximately centered around 60 GHz (e.g., 57-64 GHz). In an embodiment, the system 100 is designed for a center frequency of 59.85 GHz.

The system 100 may be advantageously applied to mobile device data communications protocols to implement 5G communication technology. For example, the system 100 may be incorporated into cellular telephones, wearable computing devices, portable music players, tablet computers, laptop computers, other types of mobile computing devices, or combinations thereof. Other benefits and advantages of the system 100 may be apparent to persons of ordinary skill in the art having the benefit of this disclosure.

Figure 2:
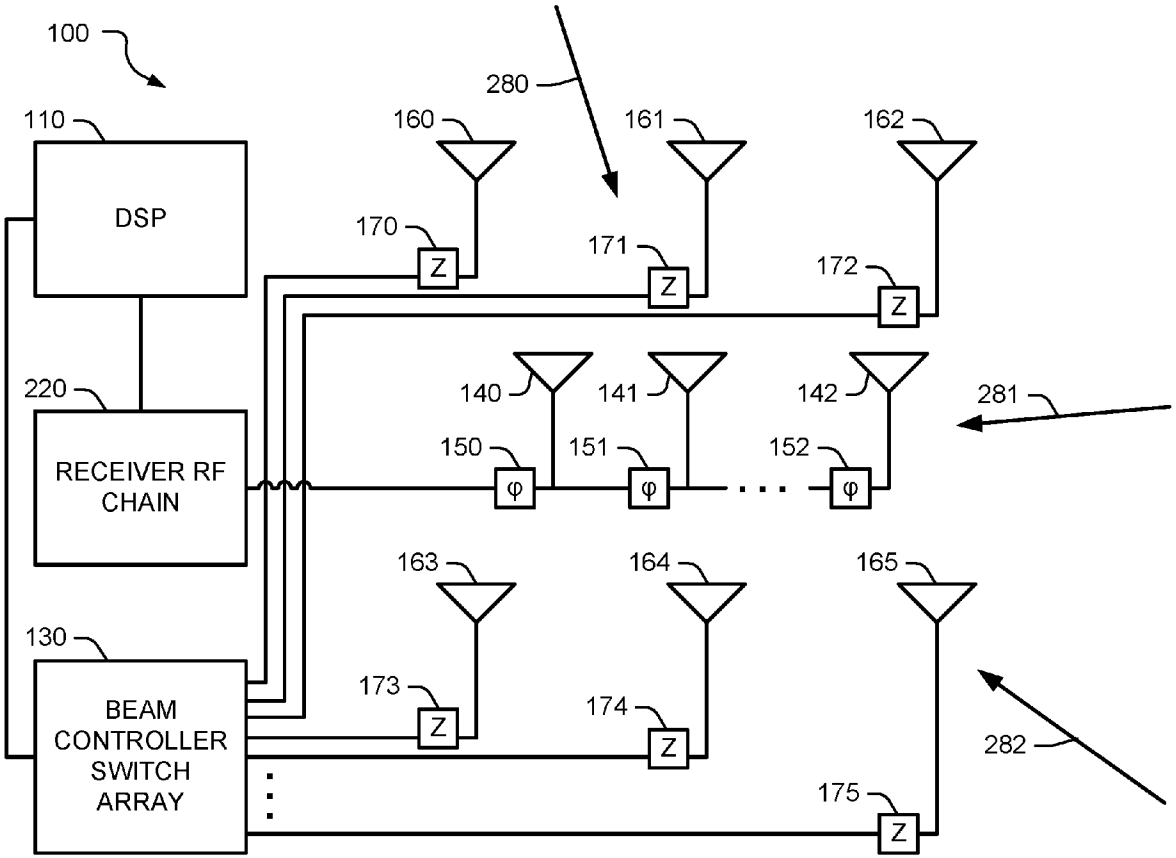
FIG. 2 is a schematic block diagram of an embodiment of a communication system configured for receiving data via multiple beams using a single radio frequency signal chain.

Referring to FIG. 2, an embodiment of a communication system is depicted and generally designated 200. In the embodiment depicted in FIG. 2, the system 200 is configured for receiving data transmissions. The system 200 differs from the system 100 in that the system 200 includes a single receiver RF chain 220 instead of the transmitter RF chain 120. Additional elements of the system 200 may also be configured to receive data transmissions as compared to the system 100, which is configured to transmit data.

During operation of the system 200, the DSP 110 may instruct the beam controller switch array 130 to control the impedance sources 170-175. As described with reference to FIG. 1, by selectively controlling and applying the impedance sources 170-175 to the multiple passive antenna elements 160-165, an antenna pattern associated with the multiple active antenna elements 140-142 may be altered to form multiple beams 280-281. The multiple beams 280-282 represent portions of the antenna pattern associated with the active antenna elements 140-142 that are better able to receive airborne data transmissions.

By altering the antenna pattern to receive data via the multiple simultaneous beams 280-282, the system 200 may enable diversity and beam-forming type MIMO communication via the single receiver RF chain 220, during data reception. Although FIGS. 1 and 2 depict separate systems for transmitting and receiving data, in some embodiments, the systems 100 and/or 200 may include components to both transmit and receive data. Thus, the principles described herein may also apply to transceiver applications.

Figure 3:
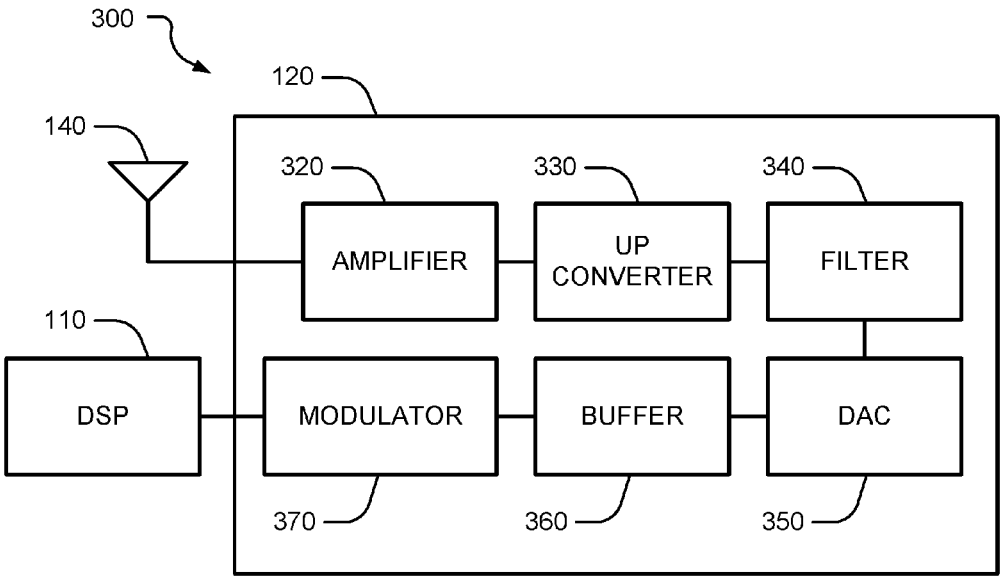
FIG. 3 is a schematic block diagram of an embodiment of a single radio frequency signal chain for receiving data.

Referring to FIG. 3 an embodiment of a system including a single transmission RF signal chain 120 is depicted and generally designated 300. Although, not shown in FIG. 3, the system 300 may include the additional elements for beam forming and steering as depicted in FIG. 1. The transmission RF signal chain 120 may include one or more components electrically coupled in series to perform operations to prepare a signal for broadcast via the antenna 310.

For example, the RF signal chain 120 may include one or more amplifiers 320, one or more up converters 330, one or more filters 340, one or more digital to analog converters 350, one or more buffers 360, and one or more modulators 370. The signal chain may receive a baseband signal from a DSP 110 and convert the baseband signal to a carrier signal for transmission via the one or more antennas 140. Although FIG. 3 depicts the components of the single transmission RF chain 120 as being arranged in a particular order, this is for exemplary purposes only. Further, additional elements and components (not depicted) may be included within the single transmission RF chain 120. Likewise, in some embodiments, one or more of the components 320-370 may be omitted.

As described with reference to FIG. 1, the single transmission RF chain may be associated with multiple beams to enable diversity and beam-forming MIMO communication for use with mm wave communication. By associating a single transmission RF signal chain with multiple transmission beams, the consumption of resources (e.g., space, power, etc.) of the system 300 may be reduced as compared to systems that include distinct RF signal chains for each beam formed.

Figure 4:
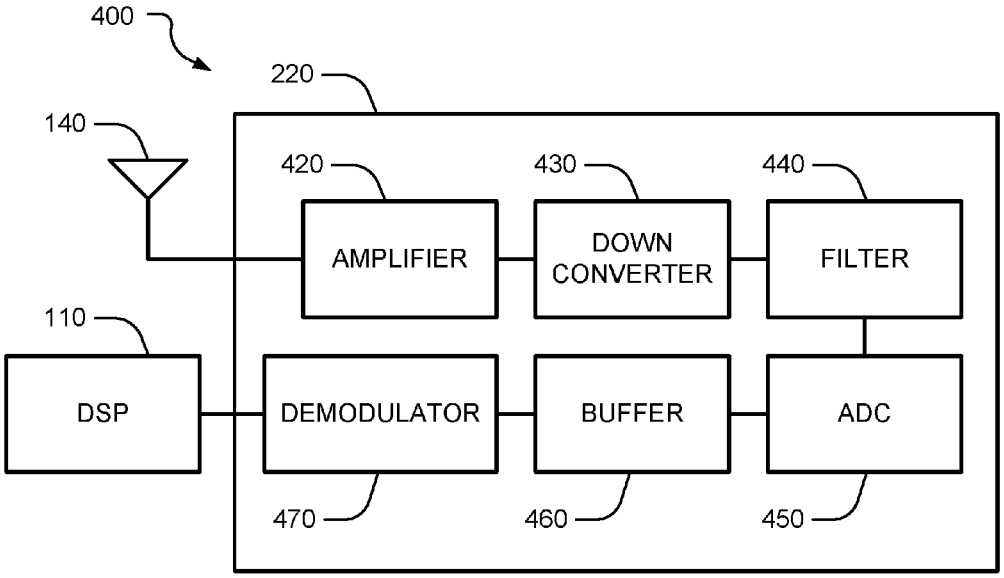
FIG. 4 is a schematic block diagram of an embodiment of a single radio frequency signal chain for transmitting data.

Referring to FIG. 4 an embodiment of a system including a single receiver RF signal chain 220 is depicted and generally designated 400. Although, not shown in FIG. 4, the system 400 may include the additional elements for beam forming and steering as depicted in FIG. 2. The receiver RF signal chain 220 may include one or more components electrically coupled in series to perform operations on a signal received via an antenna 140.

For example, the receiver RF signal chain 220 may include one or more amplifiers 420, one or more down converters 430, one or more filters 440, one or more analog-to-digital converters 450, one or more buffers 460, and one or more demodulators 470. The single receiver RF signal chain 220 may receive a carrier signal from the antenna 140 and convert the carrier signal to a baseband signal for the DSP 110. Although FIG. 4 depicts the components of the single receiver RF signal chain 220 as being arranged in a particular order, this is for exemplary purposes only. Further, additional elements and components (not depicted) may be included within the single receiver RF chain 220. Likewise, in some embodiments, one or more of the components 420-470 may be omitted.

As described with reference to FIG. 2, the single receiver RF signal chain 220 may be associated with multiple beams to enable diversity and beam-forming MIMO communication for use with mm wave communication. By associating a single receiver RF signal chain 220 with multiple beams of an antenna pattern, the consumption of resources (e.g., space, power, etc.) of the system 400 may be reduced as compared to systems that include distinct RF signal chains for each beam formed.

Figure 5:
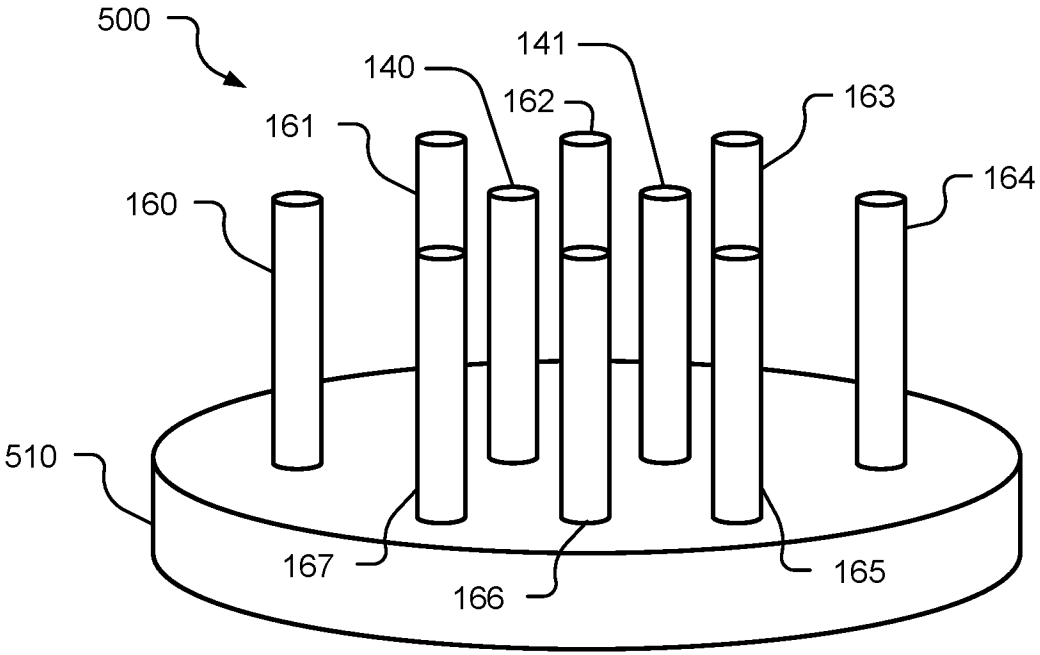
FIG. 5 is an isometric diagram of an embodiment of a reconfigurable antenna that supports multiple beams.

Referring to FIG. 5 an embodiment of a reconfigurable antenna 500 that supports multiple beams is depicted. The antenna 500 may include multiple active antenna elements 140-141, multiple passive antenna elements 160-167, and a base 510.

In the embodiment of FIG. 5, the passive antenna elements 160-167 may be positioned equidistant from the active antenna elements 140-141 in a circular or elliptical pattern. Further, each of the passive antenna elements 160-167 may be controlled individually by applying or removing impedances. As such, the reconfigurable antenna 500 may support an antenna pattern that includes multiple simultaneous beams as described herein.

By controlling an impedance coupled to particular elements coupled to the passive elements 160-167 simultaneous multiple beams emitted from the reconfigurable antenna 500 may be configured in any azimuthal direction. Although FIG. 5 depicts eight passive antenna elements 420, other embodiments of the reconfigurable antenna 400 may include more or fewer than eight. In an embodiment, the reconfigurable antenna 400 includes 12 passive antenna elements. Further, some embodiments may include more or fewer than two active antenna elements.

Figure 6:
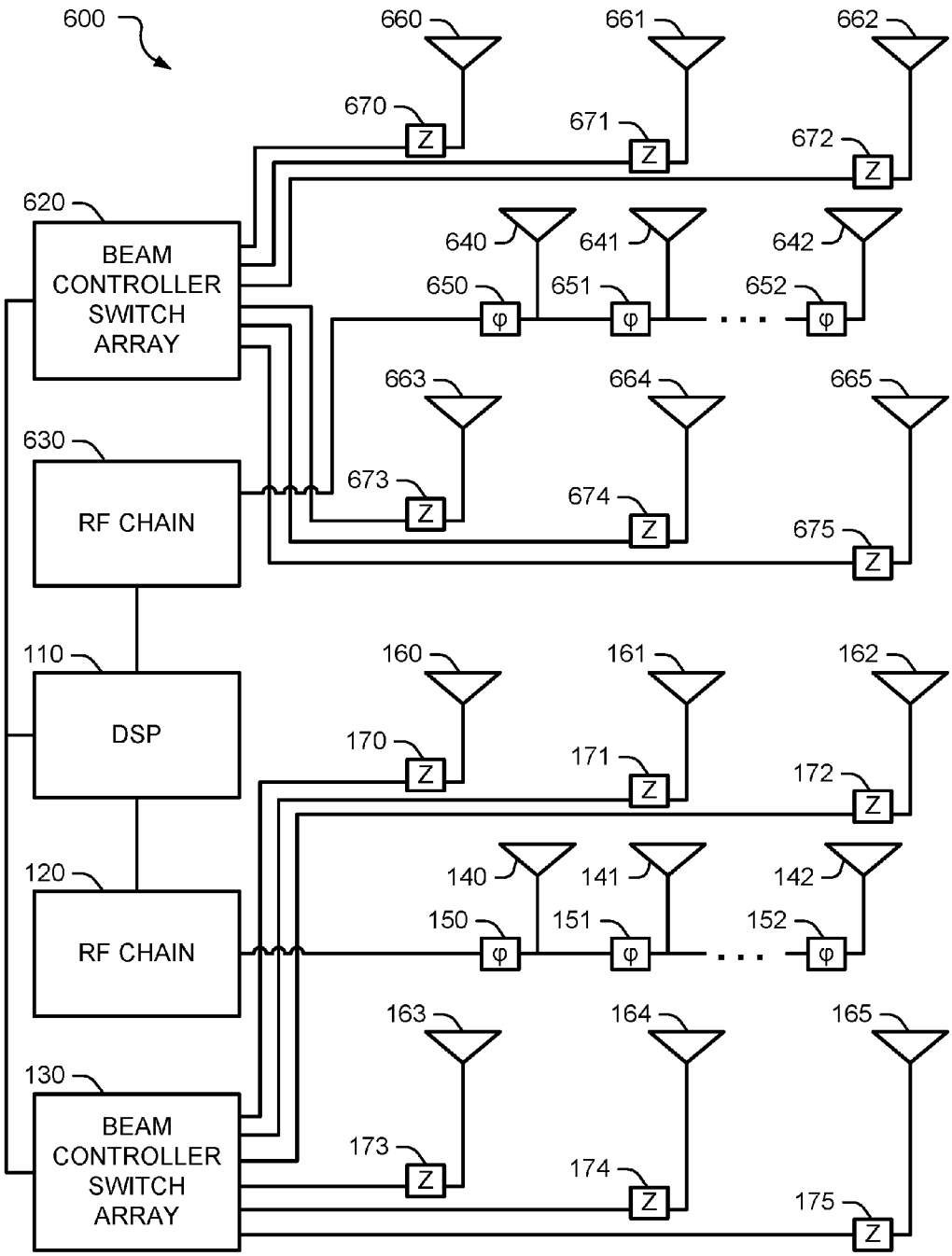
FIG. 6 is a schematic block diagram of an embodiment of a communication system that includes multiple reconfigurable antennas.

Referring to FIG. 6, an embodiment of a communication system 600 that includes multiple sets of active antenna elements is depicted. As compared to the system 100 or the system 200, the system 600 may additionally include a second set of active antenna elements 640-642, a second RF signal chain 630, a second set of passive antenna elements 660-665, additional impedance sources 670-675, and a second beam controller switch array 620. In some embodiments, the system 600 may further include additional phase shifters 650-652.

Each of the RF signal chains 120, 630 may communicate with the DSP 110 and each of the RF signal chains 120-630 may be associated with multiple beams of an antenna pattern. For example, the RF signal chain 120 may be associated with a first set of beams emitted by the active antenna elements 140-142 and the second RF signal chain 622 may be associated with a second set of beams emitted from the active antenna elements 640-642. By including two sets of active antenna elements, where each set of antenna elements is coupled to a single RF signal chain associated with multiple beams, the system 600 may support special multiplexing type MIMO communications. For example, the system 600 may support simultaneous communications where each of the RF signal chains 120, 630 may communicate individually using MIMO protocols. Further, although FIG. 6 depicts the system 600 as including two RF signal chains 120, 630 associated with multiple beams each, the system 600 may be scaled to include more than two RF signal chains associated with multiple beams each. Additionally, although system 600 may be implemented to transmit data, receive data, or both, as described herein.

Figure 7:
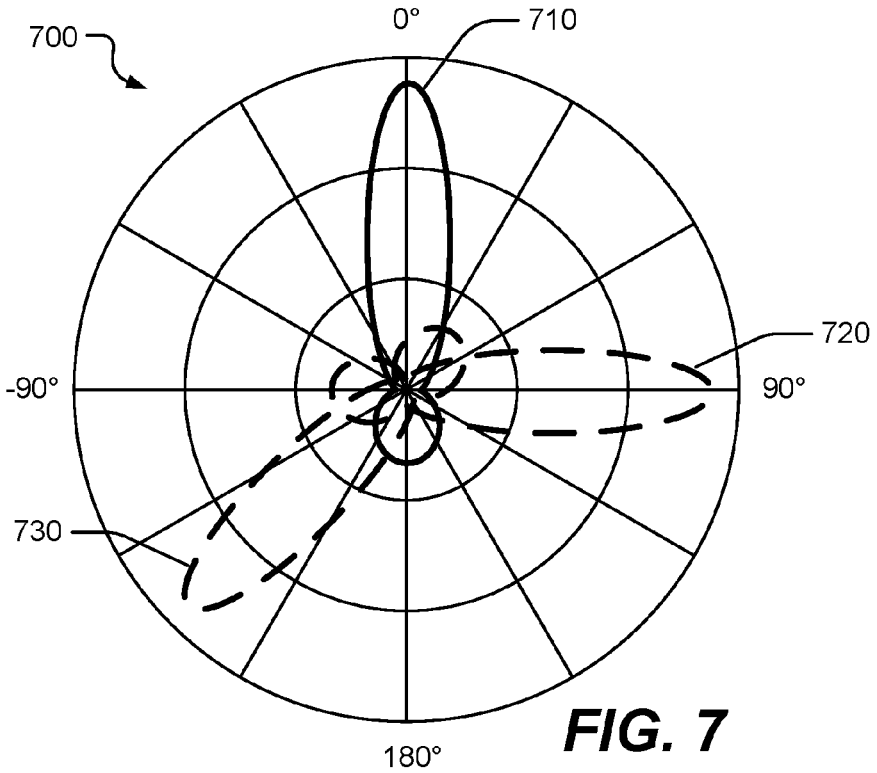
FIG. 7 is a polar diagram of an example antenna pattern of an embodiment of a communication system in a directed single-beam configuration.

Referring to FIG. 7, a polar diagram of an example antenna pattern 700 of an embodiment of a communication system in a directed beam configuration is depicted. The antenna pattern 700 may include a beam 710. It should be noted that the beam 710 is associated with a major lobe of the antenna pattern 700. The antenna pattern 700 may also include minor lobes, side lobes, and/or back lobes (not shown) that form a portion of the beams 710. These other lobes, however, do not, by themselves, form additional beams. The beam 710 may be steerable. For example, the beam 710 may be redirected to alternative beam positions 720, 730. Single beam steering, as shown in FIG. 7, however may not enable MIMO communication or optimization as described herein.

Figure 8:
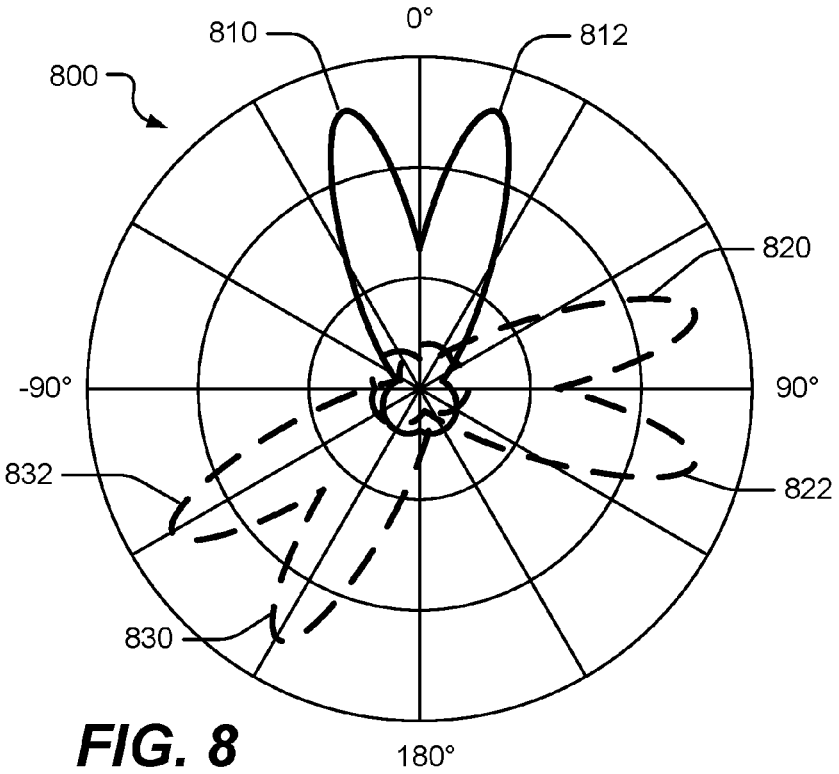
FIG. 8 is a polar diagram of an example antenna pattern of an embodiment of a communication system in a directed two-beam configuration.

Referring to FIG. 8, a polar diagram of an example antenna pattern 800 of an embodiment of a communication system in a directed beam configuration is depicted. The antenna pattern 800 may include a first beam 810 and a second beam 812. The beams 810, 812 may be steerable. For example, the beams 810, 812 may be redirected to alternative beam positions 820, 822 or beam positions 830, 832. Although not depicted in FIG. 8, the beams 810, 812 may be steerable independent of each other. For example, an angle between the beams 810, 812 may be increased or decreased as necessary to direct the beams 810, 812.

By steering the beams 810, 812, the antenna pattern 800 may provide more degrees of freedom and may support millimeter-wave communication. The antenna pattern 800 may further support MIMO communication, which enables higher data throughput for 4G and 5G systems. The MIMO communication may be performed via the multiple beams 810, 812 using a single RF signal chain. Other benefits and advantages of the antenna pattern 700 may be apparent to persons of ordinary skill in the art having the benefit of this disclosure.

Figure 9:
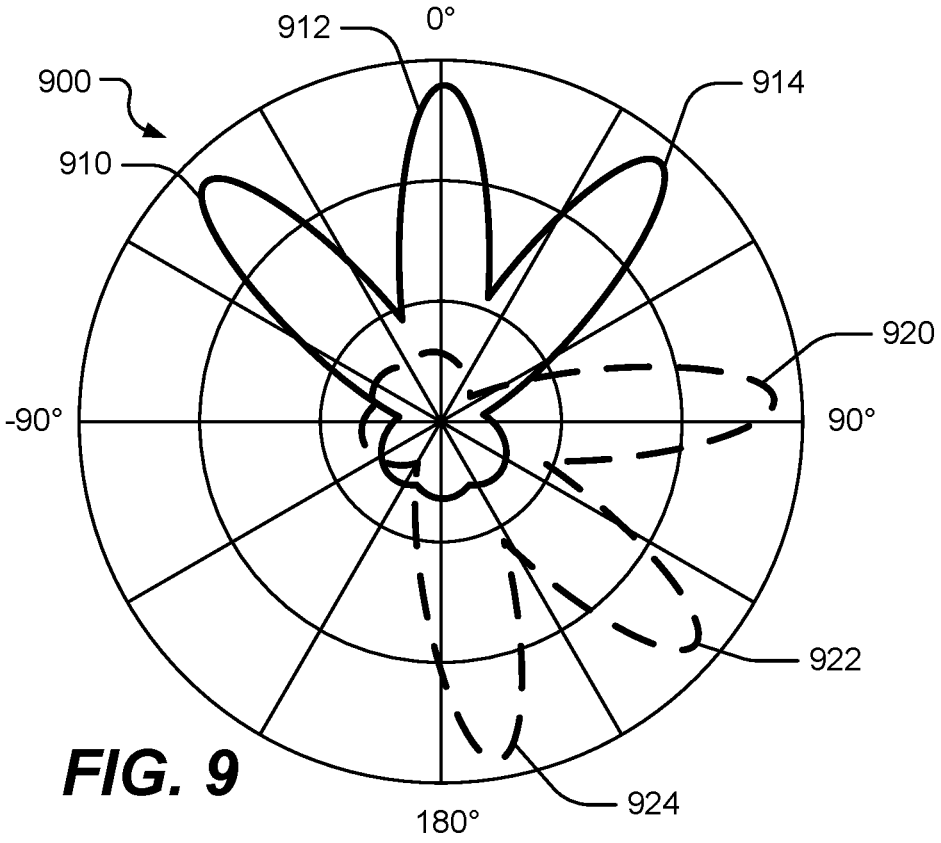
FIG. 9 is a polar diagram of an example antenna pattern of an embodiment of a communication system in a directed three-beam configuration.

Referring to FIG. 9, a polar diagram of an example antenna pattern 900 of an embodiment of a communication system in a directed beam configuration is depicted. The antenna pattern 900 may include a first beam 910, a second beam 912, and a third beam 914. The beams 910-914 may be steerable both together and independently. For example, the beams 910-916 may be redirected to alternative beam positions 920, 922, 924. By steering the beams 910-914, the antenna pattern 900 may provide more degrees of freedom than antennas that use fewer beams. Further, each of the beams 910-914 may be associated with a single RF signal chain as described herein. Other benefits and advantages of the antenna pattern 900 may be apparent to persons of ordinary skill in the art having the benefit of this disclosure.

Figure 10:
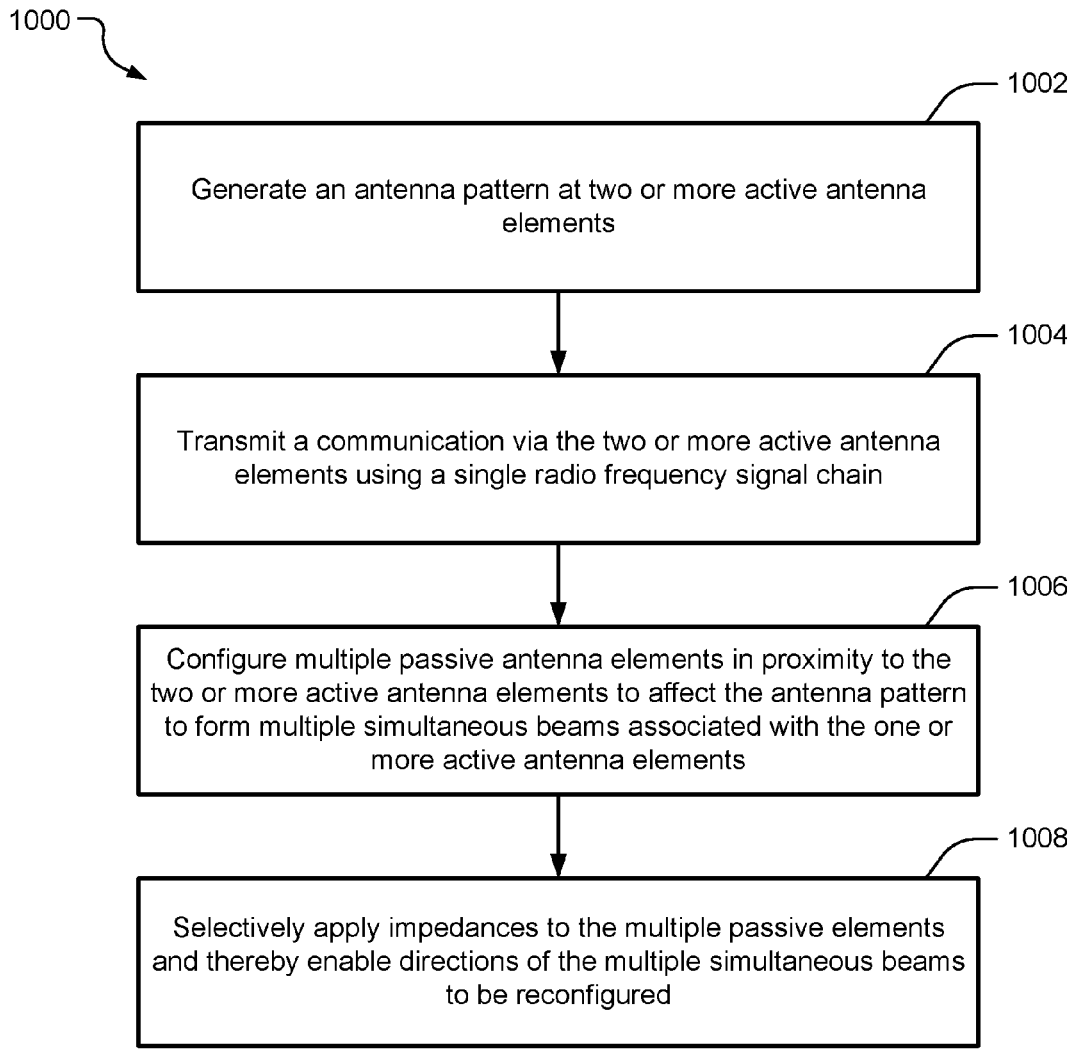
FIG. 10 is a flow diagram of an embodiment of a method for transmitting data performed by an embodiment of a communication system in a directed multi-beam configuration.

Referring to FIG. 10 an embodiment of a method 1000 is depicted. The method 1000 may be performed by the any of the systems described herein.

The method 1000 may include generating an antenna pattern at two or more active antenna element, at 1002. For example, the active antenna elements 140-142 may generate an antenna pattern.

The method 1000 may further include transmitting a communication via the two or more active antenna elements using a single radio frequency signal chain, at 1004. For example, the radio frequency signal chain 120 may be used to transmit a communication via the two or more active antenna elements 140-142.

The method 1000 may also include configuring multiple passive antenna elements in proximity to the two or more active antenna elements to affect the antenna pattern to form multiple simultaneous beams associated with the two or more active antenna elements, at 1006. For example, the beam controller switch array 130 and the impedance sources 170-175 may be used to configure the passive antenna elements 160-165 to simultaneously form the beams 180-182.

The method 1000 may include selectively applying impedances to the multiple passive elements and thereby enabling directions of the simultaneous beams to be reconfigured, at 1008. For example, the beam controller switch array 130 may selectively apply impedances from the impedance sources 170-175 to the passive antenna elements 160-165 to enable directions of the beams 180-182 to be reconfigured.

A benefit of the method 1000 is that MIMO communication may be achieved using a single radio frequency signal chain for transmitting data. Other benefits and advantages of the method 800 may be apparent to persons of ordinary skill in the art having the benefit of this disclosure.

Figure 11:
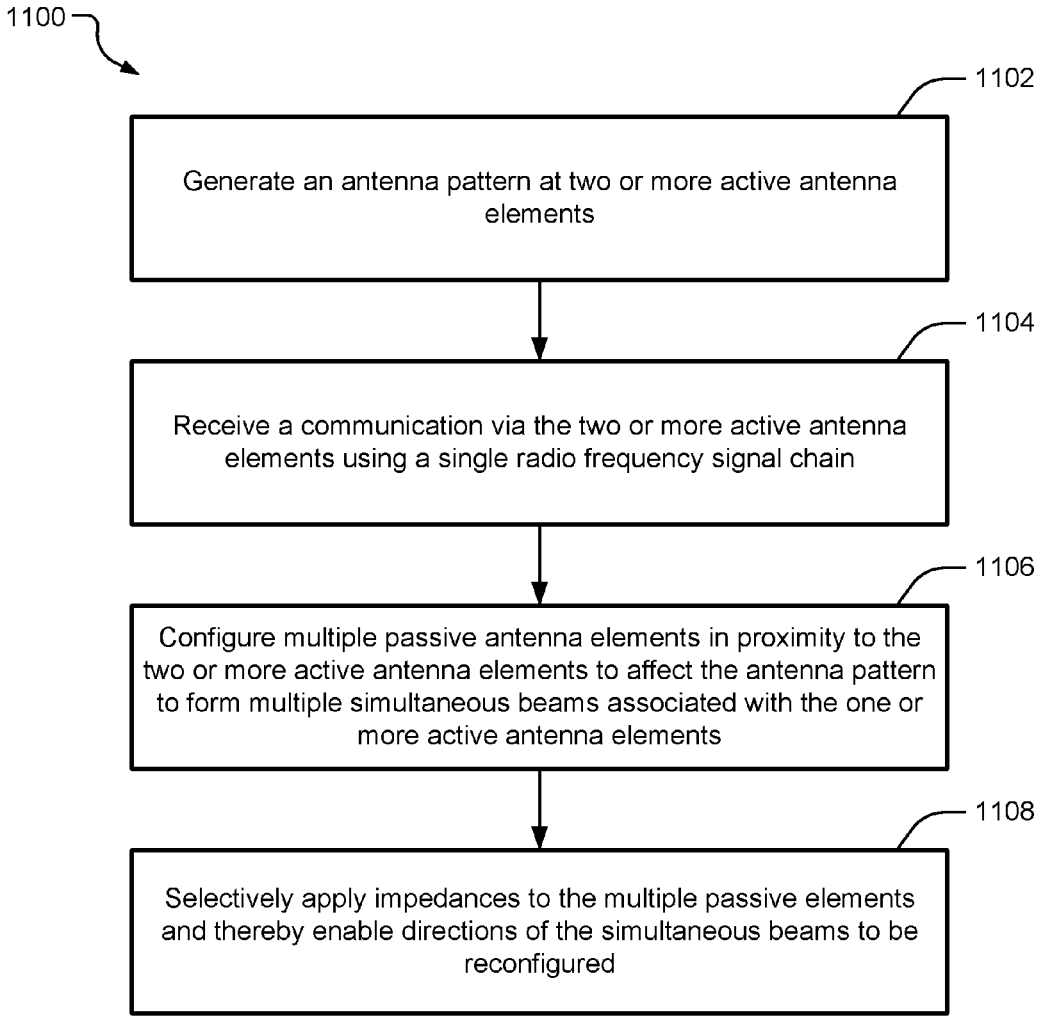
FIG. 11 is a flow diagram of an embodiment of a method for receiving data performed by an embodiment of a communication system in a directed multi-beam configuration.

Referring to FIG. 11 an embodiment of a method 1100 is depicted. The method 1100 may be performed by the any of the systems described herein.

The method 1100 may include generating an antenna pattern at two or more active antenna element, at 1102. For example, the active antenna elements 140-142 may generate an antenna pattern.

The method 1100 may further include receiving a communication via the two or more active antenna elements using a single radio frequency signal chain, at 1104. For example, the radio frequency signal chain 220 may be used to receive a communication via the two or more active antenna elements 140-142.

The method 1100 may also include configuring multiple passive antenna elements in proximity to the two or more active antenna elements to affect the antenna pattern to form multiple simultaneous beams associated with the two or more active antenna elements, at 1106. For example, the beam controller switch array 130 and the impedance sources 170-175 may be used to configure the passive antenna elements 160-165 to simultaneously form the beams 180-182.

The method 1100 may include selectively applying impedances to the multiple passive elements and thereby enabling directions of the simultaneous beams to be reconfigured, at 1008. For example, the beam controller switch array 130 may selectively apply impedances from the impedance sources 170-175 to the passive antenna elements 160-165 to enable directions of the beams 180-182 to be reconfigured.

A benefit of the method 1100 is that MIMO communication may be achieved using a single radio frequency signal chain for receiving data. Other benefits and advantages of the method 800 may be apparent to persons of ordinary skill in the art having the benefit of this disclosure.

Figure 12:
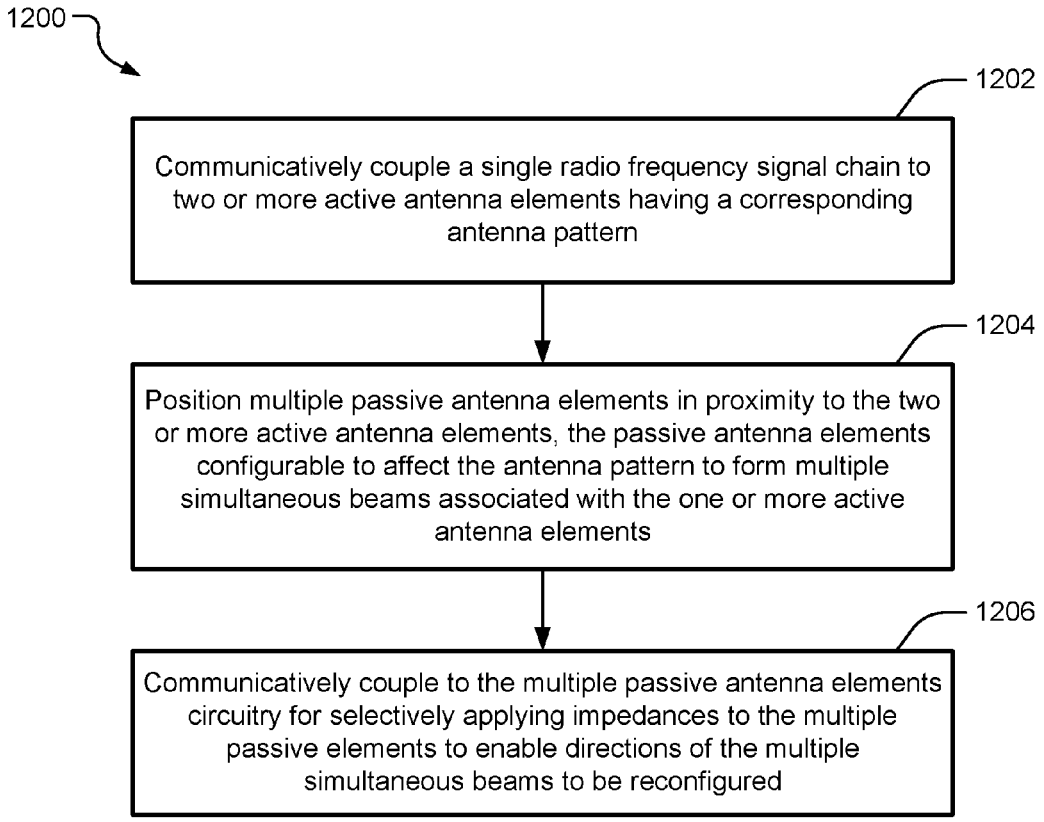
FIG. 12 is a flow diagram of an embodiment of a method of constructing an embodiment of a communication system in a directed multi-beam configuration.

Referring to FIG. 12, an embodiment of a method 1200 of constructing an embodiment of a communication system in a directed multi-beam configuration is depicted. The method 1200 may be used to construct any of the systems described herein.

The method 1200 may include communicatively coupling a single radio frequency signal chain to two or more active antenna elements having a corresponding antenna pattern, at 1202. For example, the RF signal chain 120 and/or the RF signal chain 220 may be communicatively coupled to the active antenna elements 140-142.

The method 1200 may further include positioning multiple passive antenna elements in proximity to the active antenna element, at 1204. The passive antenna elements may be configurable to affect the antenna pattern to form multiple simultaneous beams associated with the two or more active antenna elements. For example, the passive antenna elements 160-165 may be positioned proximate to the active antenna elements 140-142.

The method 1200 may also include communicatively coupling to the multiple passive antenna elements circuitry for selectively applying impedances to the multiple passive elements to enable directions of the multiple simultaneous beams to be reconfigured, at 1206. For example, the impedance sources 170-175 may be selectively coupled to the passive antenna elements 160-165. The beam controller switch array 130 may be coupled to the impedance sources 170-175 to make the selection of which impedance sources, and what resulting impedances, are applied to the passive antenna elements 160-165.

An advantage of the method 1200 is that a system may be formed that enables MIMO communication through a single RF signal chain. Other benefits and advantages of the system 900 may be apparent to persons of ordinary skill in the art having the benefit of this disclosure.

Although various embodiments have been shown and described, the present disclosure is not so limited and will be understood to include all such modifications and variations as would be apparent to one skilled in the art.

What is claimed is:

1. An apparatus comprising:

two or more active antenna elements with a corresponding antenna pattern;

a single radio frequency signal chain communicatively coupled with the two or more active antenna elements;

multiple passive antenna elements in proximity to the two or more active antenna elements, wherein the multiple passive antenna elements alter the antenna pattern to form multiple simultaneous beams associated with the two or more active antenna elements.

2. The apparatus of claim 1, further comprising a beam controller switch array that selectively applies impedances to the multiple passive elements to enable the multiple simultaneous beams to be steered.

3. The apparatus of claim 2, wherein each of the multiple simultaneous beams are independently steerable.

4. The apparatus of claim 1, the multiple passive antenna elements positioned substantially equidistant from the two or more active antenna elements and in a circular or elliptical pattern.

5. The apparatus of claim 1, further comprising two or more second active antenna elements communicatively coupled to the single radio frequency signal chain.

6. The apparatus of claim 1, wherein the multiple simultaneous beams enable millimeter wave wireless communication.

7. The apparatus of claim 1, wherein the multiple simultaneous beams enable 60 gigahertz communication.

8. The apparatus of claim 1, wherein the multiple simultaneous beams enable diversity and beam forming type multiple-input-multiple-output communication.

9. The apparatus of claim 1, wherein the multiple simultaneous beams enable special-diversity-type multiple-input-multiple-output communication.

10. The apparatus of claim 1, the single radio frequency signal chain including one or more signal amplifiers, one or more signal converters, one or more signal buffers, one or more digital-to-analog converters, one or more analog-to-digital converters, one or more signal modulators or demodulators, or combinations thereof, configured in series to form a signal chain.

11. The apparatus of claim 1, incorporated into a mobile computing device selected from the group consisting of cellular telephones, wearable computing devices, portable music players, tablet computers, and laptop computers.

12. A method comprising:

generating an antenna pattern at two or more active antenna elements;

transmitting or receiving a communication via the two or more active antenna elements using a single radio frequency signal chain;

altering the antenna pattern, using multiple passive antenna elements in proximity to the two or more active antenna elements, to form multiple simultaneous beams associated with the two or more active antenna elements.

13. The method of claim 11, further comprising:

selectively applying impedances to the multiple passive elements and thereby steering the multiple simultaneous beams.

14. The method of claim 13, wherein steering the multiple simultaneous beams includes steering each of the multiple simultaneous beams independently.

15. The apparatus of claim 11, wherein the communication is transmitted via millimeter wave wireless communication.

16. The apparatus of claim 1, wherein the communication is transmitted via 60 gigahertz communication.

17. The apparatus of claim 1, wherein the communication is transmitted via multiple-input-multiple-output communication using the single radio frequency signal chain and the two simultaneous beams.

18. A method comprising:

communicatively coupling two or more active antenna elements to a single radio frequency signal chain, the two or more active antenna element having a corresponding antenna pattern;

positioning multiple passive antenna elements in proximity to the two or more active antenna element, wherein the multiple passive antenna elements alter the antenna pattern to form multiple simultaneous beams associated with the two or more active antenna elements.

19. The method of claim 18, further comprising:

communicatively coupling a beam controller switch array to the multiple passive elements to enable steering of the multiple simultaneous beams.

20. The method of claim 18, further comprising:

positioning the multiple passive antenna elements substantially equidistant from the at least one active antenna element and in a circular or elliptical pattern.

* * * * *